United States Patent [19]

Bilson et al.

[11] 4,152,757

[45] May 1, 1979

[54] TERMINAL STRUCTURE FOR OUTDOOR LUMINAIRE

[75] Inventors: Edward B. Bilson; Billy L. Shelby, both of Memphis, Tenn.

[73] Assignee: International Telephone and Telegraph Corporation, New York, N.Y.

[21] Appl. No.: 811,170

[22] Filed: Jun. 29, 1977

[51] Int. Cl.[2] ..... F21S 1/10; F21V 21/00

[52] U.S. Cl. ..... 362/217; 285/31; 285/DIG. 8; 362/147; 362/223; 362/311; 362/371; 362/430; 362/431; 362/432; 362/457

[58] Field of Search ..... 362/217, 371, 430, 431, 362/432, 457; 285/31, DIG. 8; 174/75 D, 101

[56] References Cited

U.S. PATENT DOCUMENTS

| | | | |
|---|---|---|---|
| 2,482,129 | 9/1949 | Schneiderman | 362/217 X |
| 3,142,501 | 7/1964 | Clark et al. | 362/431 X |
| 4,064,432 | 12/1977 | Compton et al. | 362/431 X |

*Primary Examiner*—Richard D. Lovering

*Attorney, Agent, or Firm*—James B. Raden; Marvin M. Chaban

[57] ABSTRACT

A weatherproof terminal or junction box structure for a luminaire adapted for connection by a mast to a building or pole. The structure enables access to the terminal or junction box area for wiring and inspection without disassembly of the mounting of the luminaire to the mast and without the necessity of disassembling the luminaire itself. The mast telescopes within a channel receiver of the luminaire housing for mounting purposes. The mast is slotted at its entry end, the slot being encompassed within an access opening which may be covered by a wire way cover. Removal of the cover exposes the wiring for connection and inspection. With the cover in place, recessed within the receiver, the connection of mast to luminaire produces a weatherproof mounting. A second embodiment omits the need for the cover by normally setting the entry end slot rotated out of registration with the channel opening. Access to the slot may be had by rotating the luminaire about the axis of the channel receiver.

4 Claims, 5 Drawing Figures

42
14
40
44
48
52
46
70
74
80
78
76
64
62
72
54
34
60
28
56
32
30
10
16
26
24
20
22
18
19

TERMINAL STRUCTURE FOR OUTDOOR LUMINAIRE

BACKGROUND OF THE INVENTION

It is conventional in the outdoor luminaire art to employ a telescoping mounting relationship of the mast arm end to an integral channel receiver of the luminaire housing to support the luminaire on the mast arm. The mast is hollow and serves as a wireway for connecting wires of the luminaire. The wires are generally connected within the luminaire housing either directly to a terminal board or to wires connected to the lamp and controls. An example of this mounting structure is shown by U.S. Des. No. 179,339 issued Dec. 4, 1956 to Clark.

The mast is secured within the receiver by suitable bolts and the bolts once tightened are generally not removed until the luminaire requires replacement. Access to the wires for connection and inspection is made by opening the luminaire head assembly, usually by opening toggle latches and the like. The luminaire opening provides access to the lamp and exposes the interior of the luminaire.

In other known installation techniques, a generally rectangular mast is provided in which the entire bottom plate of the mast is detachable to allow access to the wireway. In this construction, the wireway bottom plate is generally hinged since it may also support the lamp ballast. An example of this type of mounting is shown by U.S. Des. No. 204,618 issued May 3, 1966 to S. M. Rutter.

In either construction, the wireway and the mounting must be weatherproof. The mounting must enable access to the wireway for snaking the wires into the housing opening for connection within the luminaire cavity. The connection must be available for inspection when necessary.

Thus, the requisites of a mast to luminaire mounting are that the mounting be weathertight, enable entry for wires into the luminaire cavity and allow access to the luminaire without materially affecting the mounting integrity of the mast to the luminaire housing.

SUMMARY OF THE INVENTION

The present invention is directed to an improvement in the mast-to-luminaire mounting which produces a weatherproof terminal compartment for snaking or threading wires both from the luminaire housing and from the mast for connection in the compartment. The terminal structure enables ready access to the compartment to connect the wires and to inspect the connection. There is no need to remove the major section of the mast and no need to open the luminaire housing by detaching the exterior glass or acrylic casing.

It is therefore a major object of the invention to provide a terminal compartment for a luminaire adapted to mount on a tubular mast, the compartment being readily available for access without the necessity of opening the lamp housing or mast housing.

It is a further object of the invention to provide a wireway adapted to telescopically mount in a channel-like receiver of the housing, the mast and housing receiver producing a wireway area which can be accessed readily and which can be covered to render the wireway and entry to both the mast and housing weatherproof.

It is still a further object of the invention to provide a mast-to-luminaire mounting in which the mast is slotted in an area of an opening of the housing to render the interior of the mast end accessible from the exterior of the housing, the mounting being coverable by a readily detachable cover. With the cover in place, the mounting is weatherproof. The cover may be detachable without otherwise disturbing the mounting, the mast or the luminaire.

As a second embodiment, the cover may be omitted. For this embodiment, the access slot in the end of the mast would be oriented upwardly. By rotating the luminaire through 180° to align the slot in the channel opening, the entry to the mast with its connections is exposed.

To produce these and other objects, the mast is longitudinally slotted for a slot length contained within the extent of the luminaire support structure. The luminaire support structure in one form is downwardly open in the area of its inverted U shaped crossection. The mast is telescoped within this structure and mounted in place by the retaining screws and a mast support bracket. For the other form, the channel may be inverted.

In this way, the slot is accessible with the mast in place. The accessibility renders accessible any wires carried by the mast as they enter the luminaire, and where they may be connected to wires from the luminaire. A covering plate may be secured to the mast support bracket and may be readily detached without affecting the support bracket. In place, the cover plate (when used) nests within the confines of the U-cross section of the luminaire entry channel to enclose the terminal or junction box in a weatherproof manner. The cover can be omitted and the relationship of slot to the channel can be oriented by rotation of the luminaire.

DETAILED DESCRIPTION OF THE DRAWINGS

Figures 1, 2, 3:
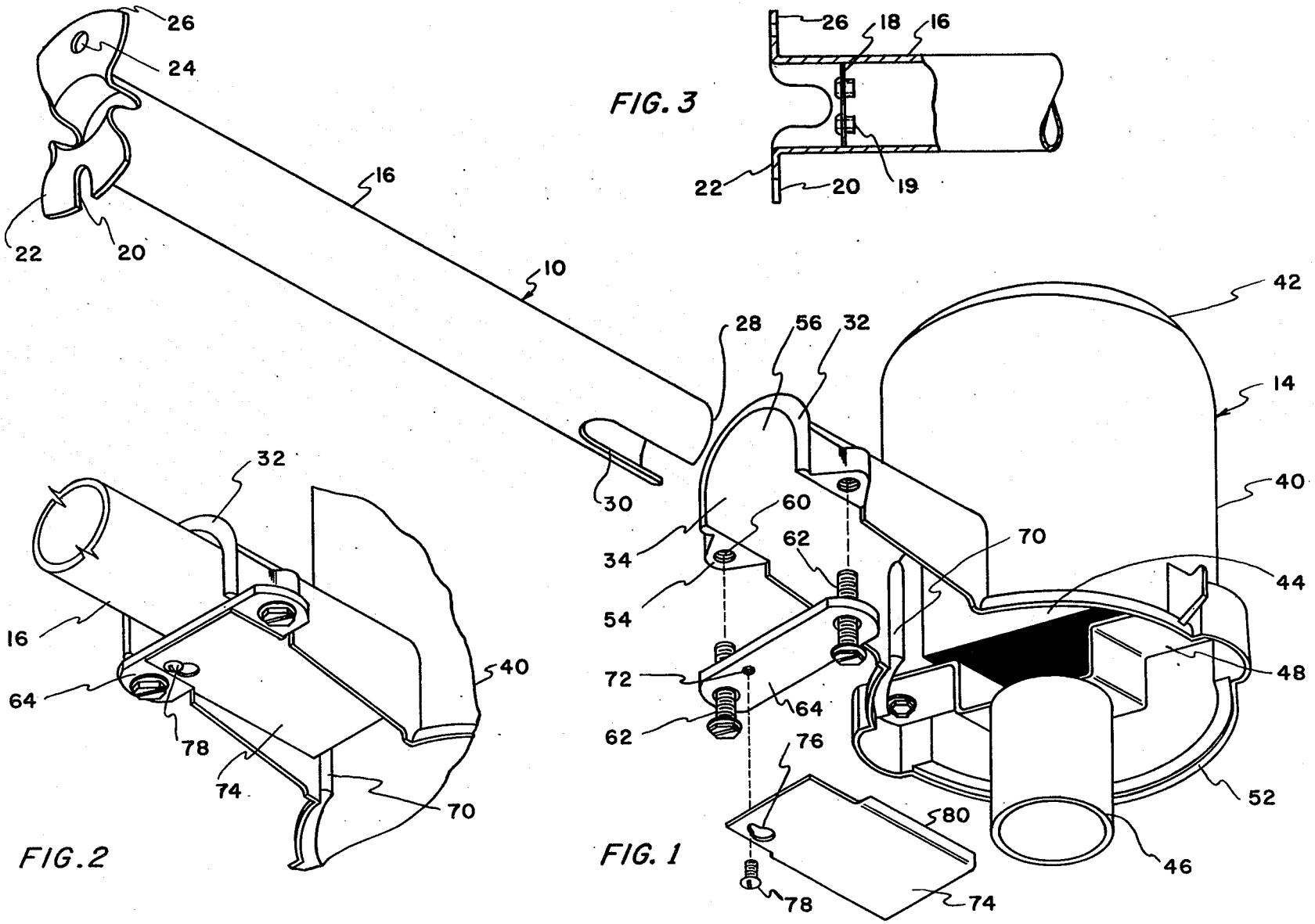
FIG. 1 is an exploded view of the mast-to-luminaire support structure employing the invention.
FIG. 2 is a partial perspective view of the support structure of FIG. 1 fully assembled.
FIG. 3 is a broken away section of the remote end of the mast of FIG. 1.

In FIG. 1, is shown an exploded view of the mounting of mast 10 to the luminaire housing 14.

The mast 10 is a rigid, tubular, usually metallic support for securing the luminaire 14 relative to a structure such as a wall or pole (neither shown). The mast shown is a straight tube 16 but optionally could be arcuate. The tube shown is designed for substantially horizontal mounting but could readily be adapted for angular mounting to support the luminaire at a higher level than the mounting to the pole or building. Within the mast, a perforated circular wire form plug 18 of suitable metal may be mounted and fitted with bushings 19 to support the wires within the mast.

At the end for supporting the mast from a structure, the wall of mast 10 is flanged at right angles to the tube length to secure the mast to the structure. The known combinations of slot 20 in the lower flange 22 and an aperture 24 in the upper flange 26 allow the mast to be attached to the structure in a conventional manner.

The area of the mast tube 16 from the area of the plug 18 to the remote end 28 of the mast serves as the wiring compartment. At the plug, the compartment is protected from water entering the compartment, with the plug bushings 19 acting to protect the insulation of the wiring compartment. The term wiring compartment denotes a totally enclosed volume in which the wiring is enclosed on all major sides by metal.

The tube 16 has a longitudinal slot 30 extending for a few inches from the tube end 28. Tube end 28 is adapted to mate telescopically within a duct like female receiver section 32 of the luminaire housing 14. The housing may be part of an otherwise well-known "Open Bottom Refractor, Mercury Luminaire" designed for outdoor use. The receiver section 32 is essentially an inverted channel, U-shaped cross section with the U opening 34 of the entry channel being open downwardly.

The receiver section 32 may be integral with the luminaire housing body, the body comprising a cylindrical main section 40 with an enclosed top 42. The main section bears ballast 44 and control mechanisms if used and a lamp socket 46 depends from the main section with a transverse bracket 48 securing the socket 46 extending downwardly from the main section. The bottom edge of the cylindrical section terminates in a stepped rim 52 which serves to receive and mate with an outer glass or acrylic enclosure (not shown) of any known shape, the enclosure serving as a diffuser or lens for light emitted from a lamp (not shown) within socket 46. The lower section (as viewed in FIG. 2) is covered by a section of refractors which extends to the mast cover to close the luminaire receiver 32 and render it weatherproof.

Adjacent its outer lateral end, the receiver section has opposed bosses 54 extending outwardly of the extension body. The bosses 54 combinedly form a discontinuous flat surface spaced from the base 56 of the cross section of the U, a distance slightly less than the diameter of the mast. The bosses have circular openings 60 which preferably are threaded to receive bolts 62 to clamp a mast support bar 64 to the receiver section.

The receiver section has at its juncture to the luminaire main section, arcuate blocking ridges 70 intruding into the area of the receiver cross section to block the entry of the mast into the luminaire cavity and to firmly locate the mast relative to the receiver section.

The support bar or support bracket 64 has a tapped hole 72 adjacent one bolt opening, the hole 72 being of lesser diameter than the openings for bolts 62. This hole 72 is used to mount the cover or inspection plate 74. The inspection plate has a slotted opening 76 for screw 78 to secure the plate 74 to the support bar in the manner shown best in FIG. 2 with the plate nested within the cross section of the receiver section.

An arcuate plate (not shown) is suitably bolted to the luminaire body in the area of the opening 34 of the channel of the mast receiver section 32. This plate completes the enclosure of the luminaire for weather proofing purposes. The plate provides sufficient space for the entry of connection wires into the luminaire from the mast. This plate does not have to be removed for inspection of the terminal structure and connections.

The cover plate 74 is an essentially rectangular, flat planar sheet of metal or the like with angled skirts 80 formed or bent at slightly greater than a right angle relative to the plane of main surface to resiliently engage the walls of the receiver section.

In order to mount a luminaire on a mast, the mast being affixed to its support structure, the support bar is loosely bolted to the bosses 54 of the luminaire. The luminaire receiver is fitted over the mast and forced onto the mast until the mast end 28 engages the stop ridges 70 to fix the position of the mast relative to the luminaire. The bolts are then tightened to clamp the mast within the receiver section. Wires may be threaded or snaked from the mast remote end or may have been in place during the securing of the luminaire, the ends of the wires extending through the slot 30 and out the bottom opening of the receiver section. The wires may then be spliced suitably to wires from the luminaire within the receiver section, this section acting as an electrical terminal or junction box.

When the splicing is complete, the inspection plate 74 is slid onto screw 78 and the screw is tightened to cover the bottom opening in the receiver section. The side skirts of the cover plate contact or engage the walls of the receiver section to provide a weatherproof cover for the junction box.

To inspect the wiring, screw 78 is loosened and the plate 74 is slid to position the larger portion of the slot over the screw. The plate may be removed to allow access to the junction or terminal area, so exposed.

In this way, the clamping bar need not be loosened and the cover of the luminaire need not be removed. The cover plate may again be restored to position and screw 78 tightened.

Figure 4:
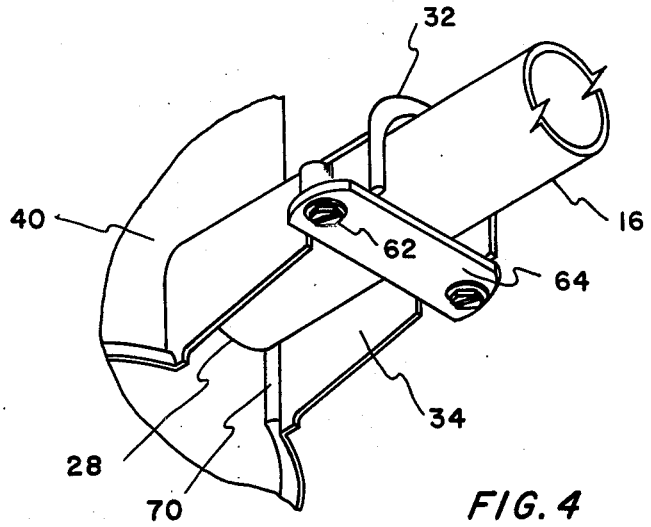
FIG. 4 is a partial perspective view similar to FIG. 2, of a second embodiment of my invention.
Figure 5:
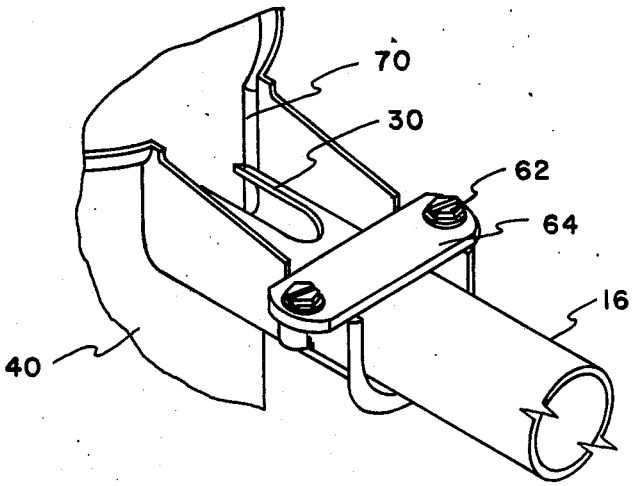
FIG. 5 is a partial perspective view of the structure of FIG. 4 with the relationship of mast to luminaire rotated up to 180° from the showing of FIG. 4 to allow access to the mast interior.

In FIG. 4, I show a mast 16 mounted within the entry channel 34 of the luminaire mounting receiver 32. With the mast 10 fully inserted into the channel abbutting, the blocking ridges 70, the slot 30 is covered by the channel wall of entry 32. To obtain access to the compartment and slot 30, screws 62 may be loosened slightly to allow the luminaire to be rotated to the position of FIG. 5. To close the compartment the luminaire is rotated to cover the slot. The amount of rotation necessary to cover the slot may be 90° or up to 180° as desired. The support bolts are retightened in the position of FIG. 4 to close the wiring compartment.

What is claimed is:

1. A luminaire support structure for mounting a luminaire on a supporting mast having a tubular wall, comprising a mast receiver extending from said luminaire, said receiver comprising an open channel section with an open port at the end thereof, the base of said channel section sized to receive said mast wall in a tight-fitting, telescoping relation, said mast having a wire-receiving plug closing the bore of said mast at a location remote from the luminaire mounting, a longitudinal slot in the wall of said mast within the area telescoped within said receiver, means for clamping and holding said mast in said receiver, said clamping means allowing ready access to said mast slot through the open side of said channel, said mast and receiver cooperatively forming a terminal compartment to allow the making and inspecting of electrical connections within said mast through the opening formed by the alignment of said slot with the open side of the channel without disturbing the holding of the mast in said receiver, and means for covering the open side of said channel section to close access to said compartment through said slot whereby to weatherproof said compartment and its connection to the luminaire.

2. A support structure as claimed in claim 1, wherein said clamping means comprises a support bar extending across the legs of the channel section and secured thereto, said covering means comprises a flat sheet member adapted to rest between the legs of said channel and to be secured thereto.

3. A support structure as claimed in claim 1, wherein said covering means include the wall of said mast adjacent said slot and the wall of said channel section, with one of said walls rotatable about an axis parallel to the length of said mast to cover or uncover said slot.

4. A luminaire support structure adapted to support a luminaire on a supporting mast by means of a mast receiver extending from said luminaire, in which said receiver comprises an open channel section with a U-shaped wall member having a port at the end of the channel section, the base of said channel section wall member sized to receive said mast in a tight-fitting telescoping relation, said mast comprising a tubular wall member, a longitudinal slot inset into the tubular wall member of said mast extending only within the area telescoped within said receiver, a clamping plate securable to said receiver for clamping said mast firmly in said receiver, said clamping plate allowing ready access to said mast slot through the open channel of the U-shaped wall member, said mast and receiver cooperatively forming a terminal compartment externally of the luminaire to allow the making and inspecting of electrical connections to said luminaire through the opening produced by the registry of the slot with said open channel, the receiver channel wall member positioned to cover the slot with one of said wall members rotated to close the opening to said compartment whereby to weatherproof said compartment and its connection to the luminaire.

* * * * *